US005348073A

United States Patent [19]

Kubo et al.

[11] Patent Number: 5,348,073

[45] Date of Patent: Sep. 20, 1994

[54] METHOD AND APPARATUS FOR PRODUCING CAST STEEL ARTICLE

[75] Inventors: Kimio Kubo, Tochigi; Naotaka Deki, Mooka, both of Japan

[73] Assignee: Hitachi Metals, Ltd., Tokyo, Japan

[21] Appl. No.: 43,382

[22] Filed: Apr. 1, 1993

[30] Foreign Application Priority Data

| | | | |
|---|---|---|---|
| Apr. 2, 1992 | [JP] | Japan | 4-80748 |
| Sep. 24, 1992 | [JP] | Japan | 4-254398 |
| Feb. 3, 1993 | [JP] | Japan | 5-16226 |

[51] Int. Cl.[5] ..... B22D 18/06

[52] U.S. Cl. ..... 164/457; 164/65; 164/255

[58] Field of Search ..... 164/61, 63, 65, 253, 164/254, 255, 457, 154

[56] References Cited

U.S. PATENT DOCUMENTS

| | | | |
|---|---|---|---|
| 3,774,668 | 11/1973 | Heimgartner | 154/63 X |
| 4,340,108 | 7/1982 | Chandley et al. . | |
| 4,606,396 | 8/1986 | Chandley et al. . | |

FOREIGN PATENT DOCUMENTS

| | | | |
|---|---|---|---|
| 55-46781 | 11/1980 | Japan | 164/63 |
| 57-31463 | 2/1982 | Japan . | |
| 60-3959 | 1/1985 | Japan | 164/65 |
| 60-15062 | 1/1985 | Japan | 164/65 |
| 60-56439 | 4/1985 | Japan . | |
| 60-35227 | 8/1985 | Japan . | |
| 61-180642 | 8/1986 | Japan . | |
| 61-245941 | 11/1986 | Japan | 164/61 |
| 62-40966 | 2/1987 | Japan | 164/253 |
| 3-146255 | 6/1991 | Japan | 164/63 |
| 4-147760 | 5/1992 | Japan . | |
| 4-218645 | 8/1992 | Japan . | |

*Primary Examiner*—J. Reed Batten, Jr.
*Attorney, Agent, or Firm*—Finnegan, Henderson, Farabow, Garrett & Dunner

[57] ABSTRACT

The apparatus for producing a cast steel article has a permeable mold having a cavity, a sprue and at least one rise/run-off portion, and a vacuum apparatus, the permeable mold being provided with a hole having an opening on a mold surface near the rise/run-off portion, the vacuum apparatus being provided with a suction pipe having an opening which is brought into contact with the hole of the permeable mold, wherein the air is sucked from the hole by the vacuum apparatus, in order to conduct the casting of the article at reduced pressure.

22 Claims, 8 Drawing Sheets

METHOD AND APPARATUS FOR PRODUCING CAST STEEL ARTICLE

BACKGROUND OF THE INVENTION

The present invention relates to a method of producing a cast steel article by using a permeable mold such as a sand mold, more particularly to a method of producing a thin cast steel article made of stainless steel, heat-resistant steel, etc. without suffering from casting defects such as insufficient filling, shrinkage cavities, blow holes, metal penetration, etc., and an apparatus for such a method.

Since exhaust equipment members for automobiles, for instance, prechambers, port liners, exhaust manifolds, turbocharger housings, exhaust outlets connected right under turbochargers, and parts for exhaust gas-cleaning members such as exhaust gas-cleaning catalytic converters, etc. are produced by metals having high heat resistance and oxidation resistance. For such applications, stainless steel and heat-resistant cast steel have recently been attracting much attention and have started to be put into practical use. However, since these stainless steel and heat-resistant cast steel generally have high melting points, their melts poured into a sand mold are easily solidified upon coming into contact with the cavity wall of the sand mold. Also, even before solidification, their melts show high viscosity (poor fluidity), resulting in insufficient filling of the mold cavity.

Also, in a case where thin cast articles having complicated shapes are produced, the air and gas generated from the sand mold are likely to be introduced into the resulting cast articles as blow holes, gas defects, etc. Further, since their melts are poured at high temperatures, they are easily reacted with the sand mold, resulting in metal penetration, which leads to provide the cast products with rough surfaces. Accordingly, it has been extremely difficult to produce cast articles having portions as thin as 5 mm or less from stainless steel and heat-resistant cast steel without defects.

One method for overcoming the above problems is a so-called lost wax method utilizing a mold made of ceramics. In this method, the mold is heated to 700°–900° C. before pouring the melt to reduce the cooling speed of the melt in the mold, thereby preventing the flowability of the melt from decreasing. However, this method is costly because expensive ceramic molds are used.

An alternative method for improving the flowability of the melt is a vacuum casting method in which casting is conducted under reduced pressure in a mold cavity. For instance, Japanese Patent Publication No. 60-35227 discloses such a vacuum casting method called "CLAS method," which is recently utilized for producing thin castings. This method is attracting much attention as a method for producing thin cast articles. However, in this conventional vacuum casting method, the mold is immersed in a melt. Accordingly, complicated structure and mechanism are necessary for holding and immersing the mold in the melt.

Japanese Patent Laid-Open No. 61-180642 discloses a vacuum control means in which a melt is poured into a permeable mold after a chamber containing the permeable mold is sucked. However, since the entire portion of the permeable mold is sucked, the disturbance of flow is likely to take place in the melt, resulting in cast steel article with blow holes, etc. Also, the chamber may be exploded due to the gas generated from the mold.

Japanese Patent Laid-Open No. 57-31463 discloses the production of thin castings in which a melt is poured into a cavity while evacuating through a hole positioned most distant from a sprue to increase the flowability of the melt. However, since suction is conducted through all of the inner surface of the cavity in this process, large suction effect cannot be achieved in necessary portions, and the melt flow is likely to be disturbed, resulting in the inclusion of air, slag, etc. into the cast articles.

Japanese Patent Laid-Open No. 60-56439 discloses a gypsum mold for vacuum-casting thin articles free from casting defects due to insufficient filling and gas defects due to the inclusion of the air, which is provided with a filter made of a refractory material having better gas permeability than that of the gypsum in an area ranging from a last-filled portion of the cavity to an outer surface of the gypsum mold, thereby increasing the pressure reduction effect in the cavity. Since gypsum is used for the mold, the penetration of the melt into the mold hardly occurs. However, a lot of steps are needed to produce the gypsum mold, resulting in poor productivity as compared with the sand mold. Also, since the gypsum mold does not have a good gas permeability, back pressure in the cavity increases in the process of casting, resulting in poor flow of the melt.

Japanese Patent Laid-Open No. 4-147760 discloses a sand mold for producing thin castings free from gas defects by a vacuum casting method, which is provided with a suction guide defining a suction path between a portion of a cavity from which the suction should be conducted and the outside, thereby locally evacuating the above cavity portion to increase the suction effect and also to suck the gas generated from the sand mold during the casting process. However, since the suction guide is embedded in the sand mold, the production of the sand mold is complicated. In addition, since the suction path defined by the suction guide is not much better in permeability than the sand mold, large suction effects cannot be obtained.

OBJECT AND SUMMARY OF THE INVENTION

Accordingly, an object of the present invention is to provide a method of producing a thin cast steel article having a high quality substantially free from casting defects at a low production cost.

Another object of the present invention is to provide an apparatus for carrying out such a method.

In view of the above objects, the inventors of the present invention have found that by disposing a rise/-run-off portion communicating with a cavity in a permeable mold such as a sand mold at a position apart from a gate of the permeable mold, by providing the permeable mold with a hole communicating with the outside near the rise/run-off portion, and by sucking the air from the hole of the permeable mold to reduce the pressure in a cavity of the permeable mold, a melt poured into the permeable mold can sufficiently enter into the cavity without including the air and gas generated from the permeable mold, resulting in good cast articles free from casting defects. Also, by disposing at least one hollow, high-gas permeability core in a cavity of the permeable mold, by connecting the hollow, high-gas permeability core to a hole having an opening on a mold surface via at least one high-gas permeability member, and by evacuating the cavity via the hole, reduced pressure can be efficiently produced in the cavity, resulting in better cast steel articles free from casting defects. The present invention has been completed based on these findings.

Thus, the method of producing a cast steel article according to the present invention comprises pouring a melt into a cavity of a permeable mold, the permeable mold being provided with at least one rise/run-off portion at a position apart from a gate of the permeable mold and a hole having an opening on a mold surface near the rise/run-off portion, while sucking the air from the hole by a vacuum apparatus, in order to conduct the casting of the article at reduced pressure.

The apparatus for producing a cast steel article according to one embodiment of the present invention comprises a permeable mold having a cavity, a sprue and at least one rise/run-off portion, and a vacuum apparatus, said permeable mold being provided with a hole having an opening on a mold surface near the rise/run-off portion, the vacuum apparatus being provided with a suction pipe having an opening which is brought into contact with the hole of the permeable mold, wherein the air is sucked from the hole by the vacuum apparatus, in order to conduct the casting of the article at reduced pressure.

The apparatus for producing a cast steel article according to another embodiment of the present invention comprises a permeable mold having a cavity, a sprue and at least one rise/run-off portion, and a vacuum apparatus, the permeable mold being provided with a hole having an opening on a mold surface near the rise/run-off portion, the vacuum apparatus being provided with a suction pipe having an opening which is brought into contact with the hole of the permeable mold, wherein at least one high-gas permeability member having a larger gas permeability than that of the permeable mold is disposed in the permeable mold between the hole the said rise/run-off portion and/or the cavity, and wherein the air is sucked from the hole by the vacuum apparatus, in order to conduct the casting of the article at reduced pressure.

The apparatus for producing a cast steel article according to a further embodiment of the present invention comprises a permeable mold having a cavity, a sprue, a gate and at least one rise/run-off portion, and a vacuum apparatus having a vacuum pump and a suction pipe, the permeable mold being provided with a hole having an opening on a mold surface near the rise/run-off portion, wherein the cavity contains at least one hollow, high-gas permeability core, one end of which is connected to the hole via a high-gas permeability member having a larger gas permeability than that of the permeable mold, the air being sucked from the hole by the vacuum apparatus, in order to conduct the casting of the article at reduced pressure.

BRIEF DESCRIPTION OF THE DRAWINGS

FIG. 2(*b*) is a vertical cross-sectional view showing another example of the sand mold usable in the method of the present invention;

FIG. 2(*c*) is a vertical cross-sectional view showing a further example of the sand mold usable in the method of the present invention;

FIG. 2(*d*) is a vertical cross-sectional view showing a still further example of the sand mold usable in the method of the present invention;

DETAILED DESCRIPTION OF THE INVENTION

The present invention will be described in detail referring to the attached drawings.

[A] Composition of Cast Steel

The cast steel to which the method of the present invention is applicable is not restricted to have a particular composition as long as it shows good heat resistance and oxidation resistance.

A typical example of such cast steel has a composition consisting essentially, by weight, of:

C: 0.05–0.45%,
Si: 0.4–2.0%,
Mn: 0.3–1.0%,
Cr: 16.0–25.0%,
W: 1.2–3.0%,
Ni: 0–2.0%,
Nb and/or V: 0.01–1.0% (each 0.5% or less), and
Fe and inevitable impurities: balance, the cast steel having, in addition to a usual $\alpha$-phase, a phase (hereinafter referred to as "$\alpha'$-phase") transformed from a $\gamma$-phase and composed of an $\alpha$-phase and carbides, an area ratio ($\alpha'/(\alpha+\alpha')$) being 20–90%, the cast steel being subjected to an annealing treatment at a temperature in the range where the $\alpha'$-phase is not transformed to the $\gamma$-phase.

This cast steel composition is described in Japanese Patent Laid-Open No. 4-218645.

[B] First Embodiment

Figure 1:
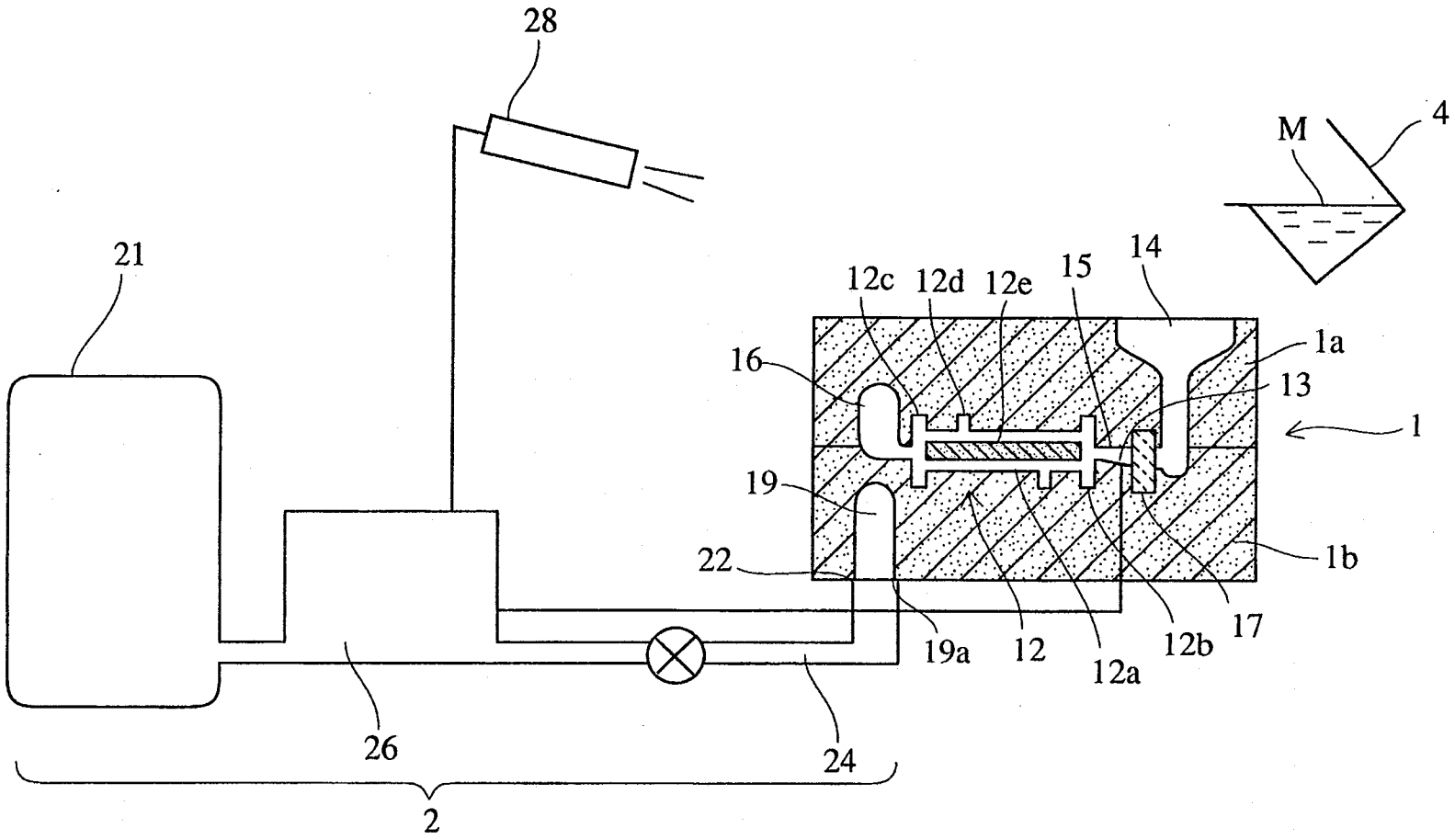
FIG. 1 is a vertical cross-sectional view showing the apparatus for producing a cast steel article according to the first embodiment of the present invention.

FIG. 1 is a vertical cross-sectional view showing the apparatus for producing a cast steel article according to the first embodiment of the present invention. The apparatus comprises a permeable mold 1 such as a sand mold and a vacuum pump 2 for reducing the pressure in a cavity of the permeable mold 1. Explanation will be made hereinafter on the sand mold as the permeable mold.

The sand mold 1 consists of two mold portions 1*a*, 1*b* both having recesses, which form a cavity 12 when the two mold portions 1*a*, 1*b* are combined. In the embodiment shown in FIG. 1, the cavity 12 is constituted by a cylindrical hollow portion 12*a* defined by the walls of the recesses of the mold portions 1*a*, 1*b* and a core 12*e*, flange-shaped hollow portions 12*b*, 12*c* disposed on both sides of the cylindrical hollow portion 12*a*, and a plurality of bosses 12*d* disposed on the periphery of the cylindrical hollow portion 12*a* in such a manner that they communicate with the cylindrical hollow portion 12*a*. Please note that a relatively simple shape of the cavity 12 is shown in FIG. 1 only for simplicity of explanation, and that any other shapes are possible for the cavity 12.

The cavity 12 communicates with a sprue 14 via a gate 15 at one end, and with a rise/run-off portion 16 at the other end. A rise has a function to apply pressure to the melt M in the cavity 12, and a run-off has a function to permit an excess melt to overflow from the cavity 12, thereby removing slag and gas included into the melt M. The rise/run-off portion 16 means a portion having both of the above two functions. The number of the rise/run-off portions 16 is not restricted to one, but a plurality of rise/run-off portions 16 may be disposed depending on the shape of the cavity 12. Also, the rise/run-off portion 16 is preferably disposed at as far a position as possible from the gate 15 to enhance degassing in the cavity 12.

A melt-detecting sensor 13 for detecting the flow of the melt M is preferably disposed in the gate 15. Also, to prevent solid impurities in the melt M from flowing into the cavity 12, a filter 17 is preferably disposed between the sprue 14 and the gate 15. The filter 17 may be a ceramic foam made of alumina, zirnon, etc., a vent hole, a molding of coarser sand such as #4 or #5 sand, etc.

The apparatus of the present invention is characterized by comprising a hole 19 having an opening on a mold surface in the sand mold 1 near the rise/run-off portion 16. In the embodiment shown in FIG. 1, the hole 19 has an opening 19*a* on a lower surface of the lower mold portion 1*b*, and extends vertically in the sand mold 1 until its tip end reaches near a lower end of the rise/run-off portion 16. The gap between the hole 19 and the rise/run-off portion 16 is preferably small as long as the strength of the sand mold 1 is not deteriorated.

An apparatus 2 for evacuating the cavity 12 of the sand mold 1 through the hole 19 comprises a vacuum pump 21, a sucking pipe (for instance, flexible pipe) 24 having at an end thereof a sucking opening 22 which is to be connected with the opening 19*a* of the hole 19, and a vacuum control means 26 mounted between the sucking opening 22 and the vacuum pump 21.

Connected to the vacuum control means 26 are an optical scope 28 for detecting when the melt M is poured into the sprue 14 from a ladle 4, and the melt-detecting sensor 13 disposed in the gate 15 of the sand mold 1. This vacuum control means 26 functions to control the vacuum degree of the cavity 12 by supplying a signal for operating the vacuum pump 21 as described later.

Next, the production of the cast steel article by using the above apparatus will be described in detail.

First, the opening 22 of the sucking pipe 24 is brought into close contact with the opening 19*a* of the hole 19. In this state, the melt M is poured into the sprue 14. When the pouring of the melt M is detected by the optical scope 28, the vacuum apparatus 2 is put into a ready state. As soon as the flow of the melt M is detected by the melt-detecting sensor 13 in the gate 15, the vacuum pump 21 is operated by the vacuum control means 26 to start the evacuation of the cavity 12.

The vacuum degree by the vacuum apparatus 2 is preferably controlled such that the flow speed of the melt M in the cavity 12 is kept substantially constant. This control may be conducted by properly adjusting the rotation speed of the vacuum pump 21 by means of an output signal of the vacuum control means 26. When the flow speed of the melt M in the cavity 12 is kept constant, the flow of the melt M in the cavity 12 is not disturbed. Also, the inclusion of the air and gas generated from the sand mold 1 into the melt M during flowing through the sprue 14, etc. can be prevented, resulting in cast steel articles free from casting defects.

As is clear from FIG. 1, since the rise/run-off portion 16 is disposed at a position far from the sprue 14, the vacuum in the hole 19 leads to the reduced pressure in the rise/run-off portion 16 and a nearby portion of the cavity 12, which in turn results in the evacuation of the cavity 12 in the direction from the gate 15 toward the rise/run-off portion 16. Accordingly, even when the cavity 12 has a thin portion (for instance, 5 mm or less), good cast steel articles free from casting defects can be produced.

Figure 2:
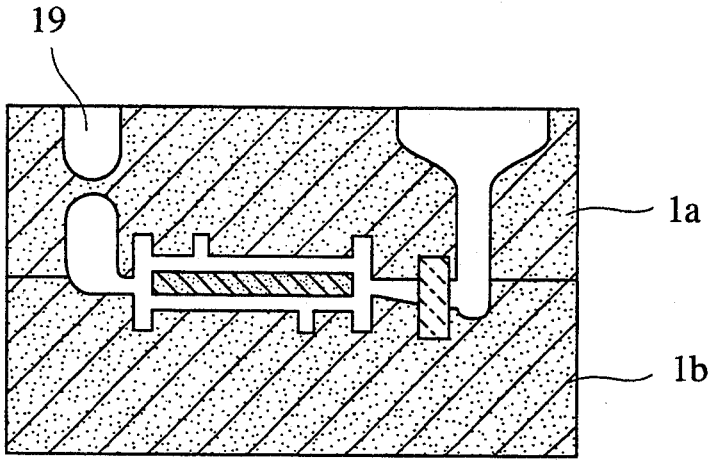
FIG. 2(*a*) is a vertical cross-sectional view showing one example of the sand mold usable in the method of the present invention.
Figure 2:
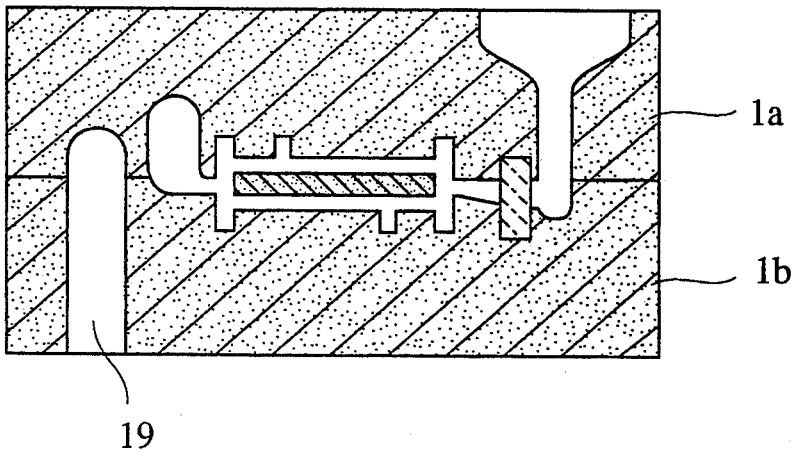
Figure 2:
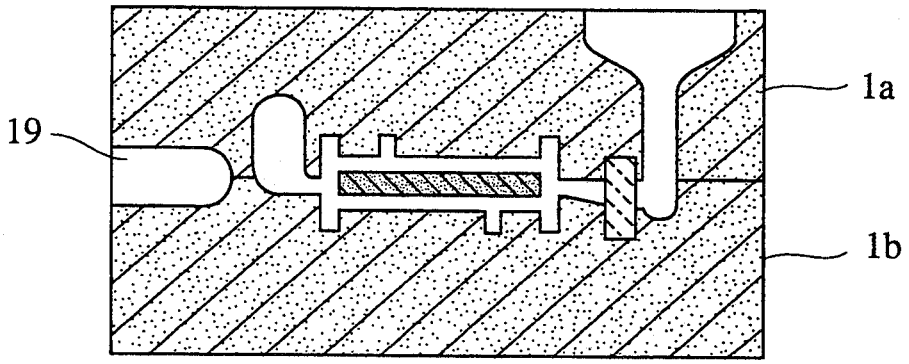
Figure 2:
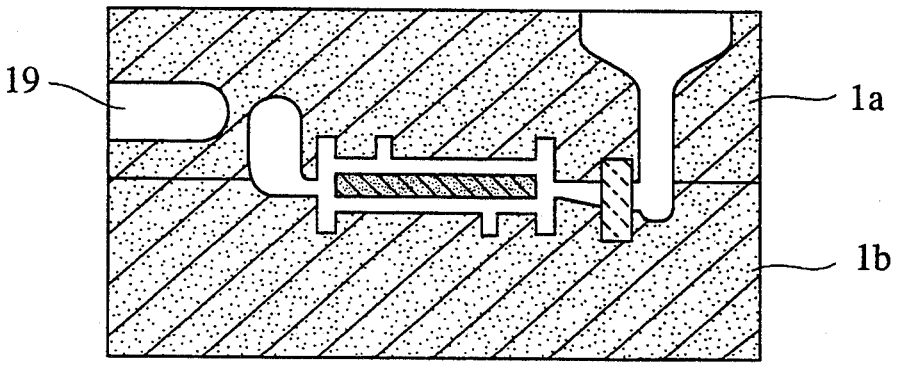

In this embodiment, the position of the hole 19 may be changed in the sand mold 1 as shown in FIGS. 2(*a*)-(*d*).

In an example shown in FIG. 2(*a*), the hole 19 is positioned above the rise/run-off portion 16 and extends vertically downward from an upper surface of the sand mold 1.

In an example shown in FIG. 2(*b*), the hole 19 extends vertically upward beyond a parting plane of the sand mold 1 from a lower surface of the sand mold 1 until its tip end reaches near a side wall of the rise/run-off portion 16.

In an example shown in FIG. 2(*c*), both of the upper mold portion 1*a* and the lower mold portion 1*b* are provided with recesses on their parting planes, which recesses form a horizontally-extending hole 19 when the upper mold portion 1*a* and the lower mold portion 1*b* are assembled.

In an example shown in FIG. 2(*d*), the hole 19 extends horizontally from a side surface of the upper mold portion 1*a* until its tip end reaches near the rise/run-off portion 16.

In these modifications, the evacuation can be conducted to produce good cast steel articles in the same manner as in the example of FIG. 1.

[C] Second Embodiment

Figure 4:
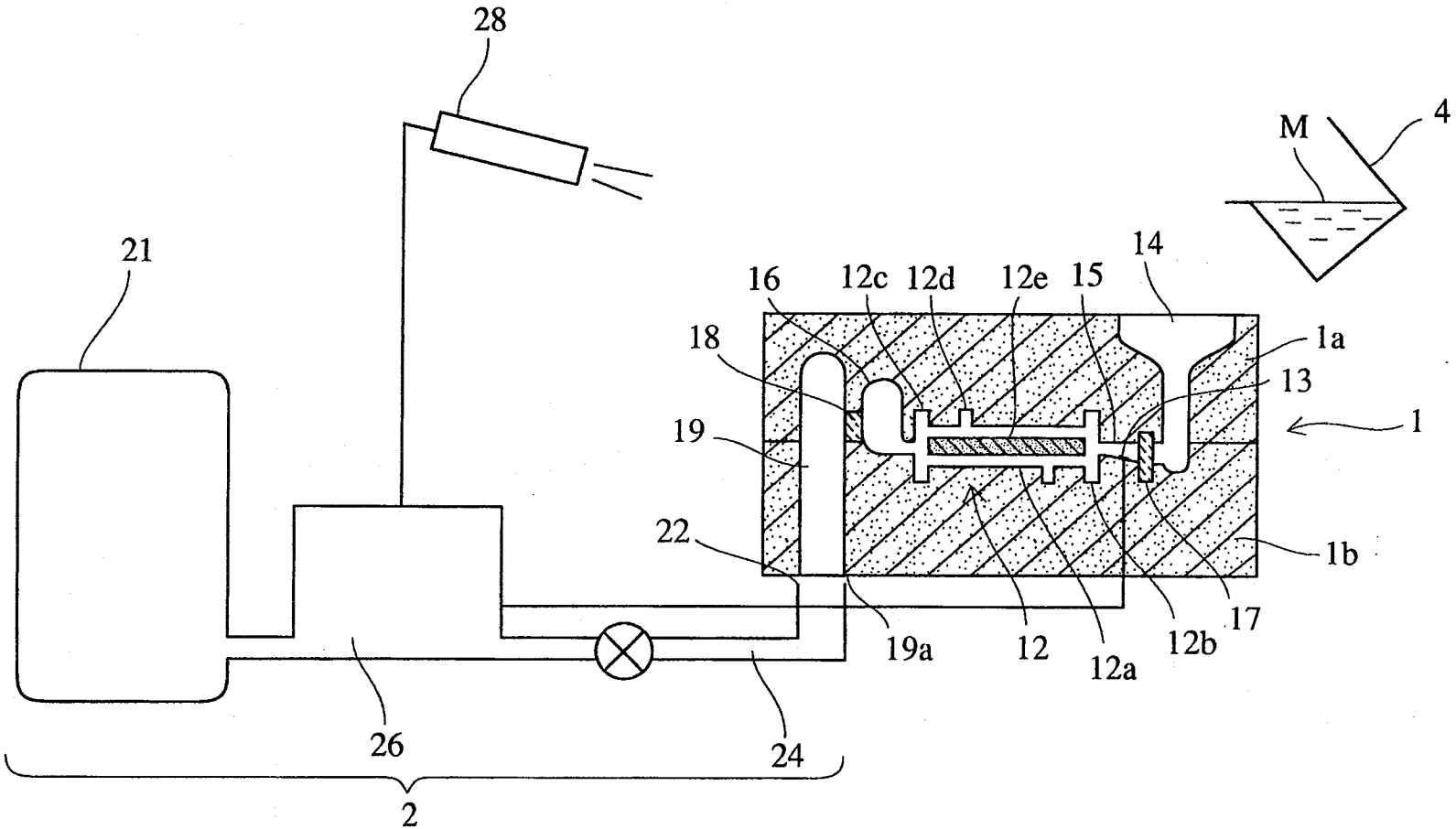
FIG. 4 is a vertical cross-sectional view showing the apparatus for producing a cast steel article according to the second embodiment of the present invention.

The second embodiment is shown in FIG. 4, in which the same reference numerals are assigned to the same members as in FIG. 1.

The sand mold 1 in the second embodiment is characterized in that a high-gas permeability member 18 having a larger gas permeability than that of the sand mold 1 is disposed in the sand mold 1 between the hole 19 and the rise/run-off portion 16 or the cavity 12. By this high-gas permeability member 18, a large vacuum degree can be achieved in the cavity 12 when a vacuum pump 21 of a vacuum apparatus 2 is operated. Since only excess melt flows into the rise/run-off portion 16, it is preferable that the high-gas permeability member 18 is disposed between the hole 19 and the rise/run-off portion 16. However, even if the high-gas permeability member 18 is disposed between the hole 19 and the cavity 12, similar suction effects can be obtained. In cases where the cavity 12 has a very complicated shape, and where a plurality of rise/run-off portions are disposed, some high-gas permeability members may be positioned between the hole 19 and the cavity 12.

To have a larger gas permeability than that of the sand mold 1, the high-gas permeability member 18 preferably has a porosity of more than 50%. An average pore size of the high-gas permeability member 18 may be such that the air can pass freely while the melt M is prevented from passing through the high-gas permeability member 18. Such an average pore size is for instance, about 400 μm. Such a high-gas permeability member 18 is preferably a ceramic foam made of alumina, zircon, etc., a vent hole, a molding of coarser sand than the sand mold 1, etc.

In the sand mold 1 in this embodiment, a part or all of the inner walls of the cavity 12, the sprue 14 and the gate 15 are coated with a mold wash (fine ceramic powder layer) of zircon flour, etc. The thickness of the mold wash is preferably about 0.1–0.5 mm, particularly about 0.2 mm so that sufficiently reduced pressure can be produced in the cavity 12 by evacuation via the hole 19. Alternatively, or in addition to the mold wash on the inner wall, an outer surface of the sand mold 1 may be coated with a mold wash to obtain the same effects. By such a mold wash, a good melt How can be obtained, and the resulting cast steel article has an improved surface smoothness.

The production of the cast steel article by using this apparatus can be conducted in the same manner as in the embodiment shown in FIG. 1.

[D] Third Embodiment

Figure 5:
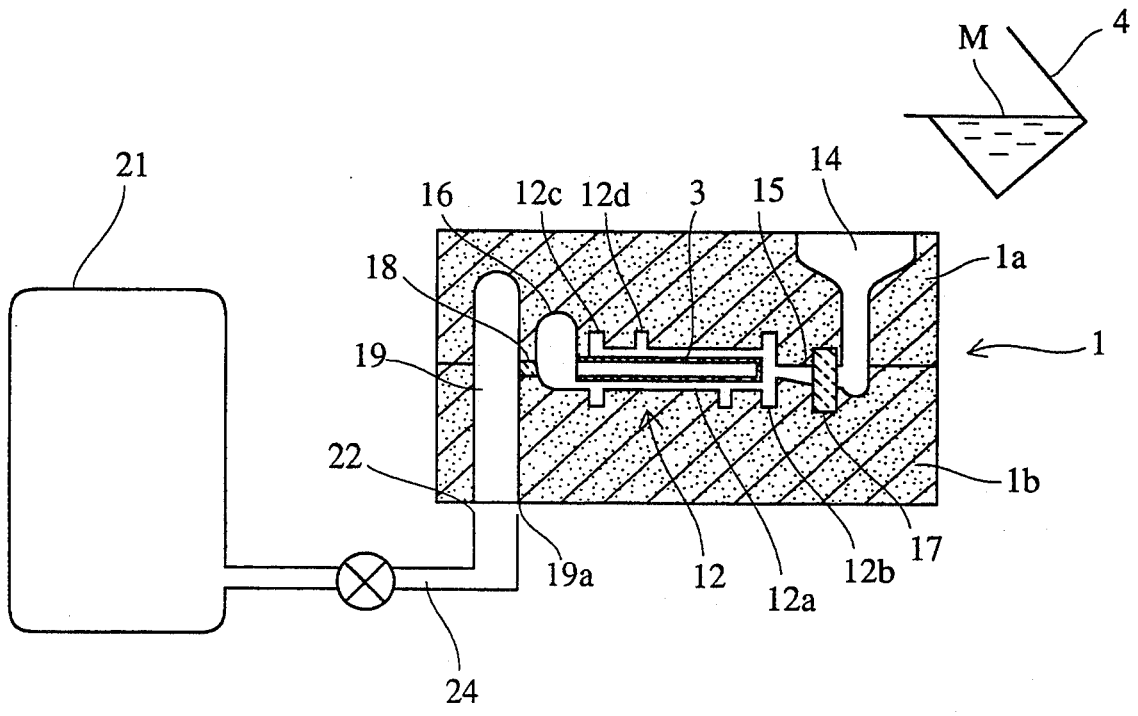
FIG. 5 is a vertical cross-sectional view showing the apparatus for producing a cast steel article according to the third embodiment of the present invention.
Figure 6:
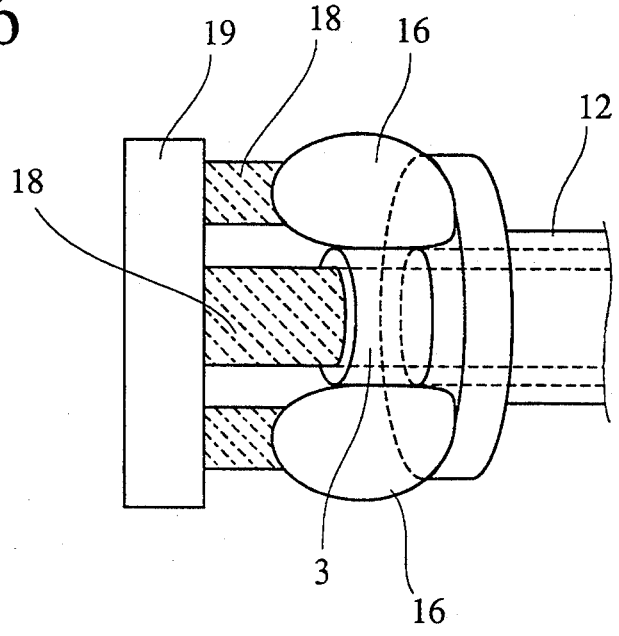
FIG. 6 is an enlarged partial side view showing the hole, the rise/run-off portion and the cavity.

The third embodiment is shown in FIGS. 5 and 6, in which the same reference numerals are assigned to the same members as in FIG. 1.

As shown in FIGS. 5 and 6, the cavity 12 contains a hollow, high-gas permeability core 3, one end of which receive a high-gas permeability member 18 connected to the hole 19 having an opening on a mold surface. The other end of the hollow, high-gas permeability core 3 may be closed. Since the air can easily pass through the hollow, high-gas permeability core 3, gas communication can be achieved between the cavity 12 and the hole 19 via the high-gas permeability member 18.

The hollow, high-gas permeability core 3 may be constituted by a ceramic foam made of alumina, etc. a molding of coarser sand such as #4 or #5 sand, etc. To have a larger gas permeability than that of the sand mold 1, the hollow, high-gas permeability core 3 preferably has a porosity of more than about 40%. An average pore size of the hollow, high-gas permeability core 3 may be such that the air can pass freely while the melt M is prevented from passing therethrough and the hollow, high-gas permeability core 3 shows sufficient mechanical strength. Such an average pore size of the hollow, high-gas permeability core 3 is, for instance, about 150 μm.

Depending on the shape of the cavity 12, the hollow, high-gas permeability cores 3 may have a plurality of openings. In such a case, a plurality of high-gas permeability members 18 are disposed between the openings of the core 3 and the hole 19.

Also, there are high-gas permeability members 18 disposed between the rise/run-off portion 16 and the hole 19. In an example shown in FIG. 6, there are one high-gas permeability member 18 between the opening of the core 3 and the hole 19, and two high-gas permeability members 18 between the rise/run-off portions 16 and the hole 19.

The production of the cast steel article by using this apparatus can be conducted in the same manner as in the embodiment shown in FIG. 1.

When the sand mold 1 is evacuated through the hole 19, the air flows from the cavity 12 to the suction pipe 24 of the vacuum apparatus 2 through the hollow, high-gas permeability cores 3, the high-gas permeability members 18 and the hole 19. Also, there are high-gas permeability members 18 between the rise/run-off portions 16 and the hole 19. Accordingly, air flow takes place in the direction toward the rise/run-off portions 16.

[E] Fourth Embodiment

Figure 10:
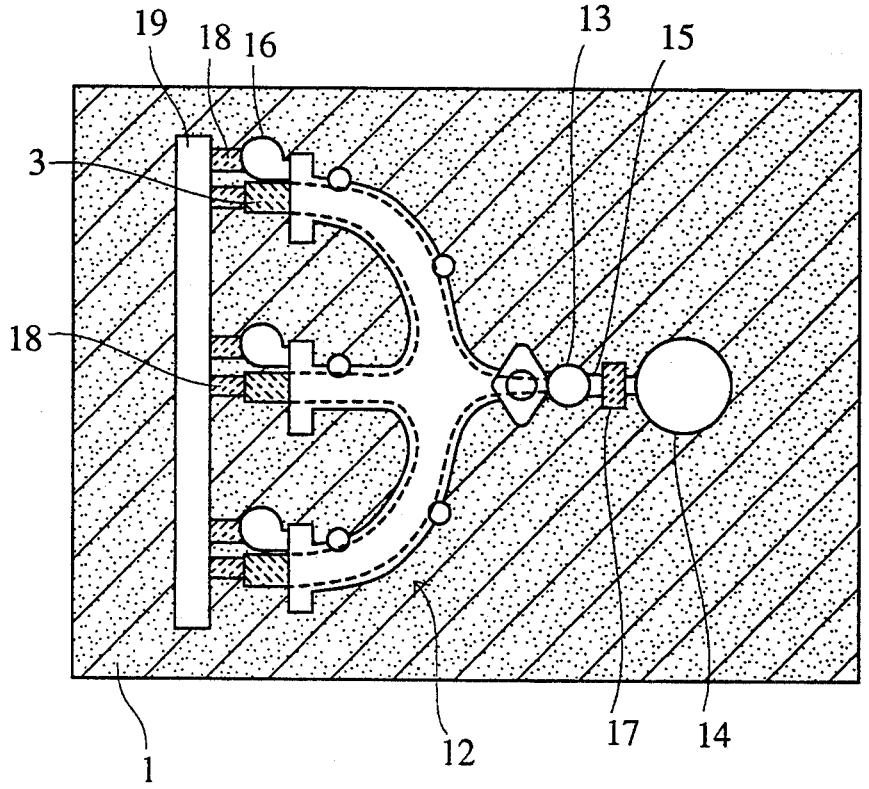
FIG. 10 is a horizontal cross-sectional view showing the apparatus for producing a cast steel article according to the fourth embodiment of the present invention.

The fourth embodiment is shown in FIG. 10, in which the same reference numerals are assigned to the same members as in FIG. 1.

In this embodiment, the cavity 12 has a plurality of branches each having an opening into which a high-gas permeability member 18 connected to the hole 19 is inserted. There are also high-gas permeability members 18 between the rise/run-off portions 16 and the hole 19.

The production of the cast steel article by using this apparatus can be conducted in the same manner as in the embodiment shown in FIG. 5.

The present invention will be described in further detail by the following Examples.

EXAMPLE 1

A two-part, cold box-type sand mold 1 having a cavity as shown in FIG. 1 was produced from silica sand #6. The cavity 12 had a cylindrical hollow portion 12*a* having an outer diameter of 45 mm, a length of 200 mm and a thickness of 2.5 mm, flange-shaped hollow portions 12*b*, 12*c* having an outer diameter of 80 mm and a thickness of 10 mm disposed on both sides of the cylindrical hollow portion 12*a*, and two bosses 12*d* having a diameter of 10 mm and a height of 15 mm.

A melt having a composition shown in Table 1 was poured into a sprue 14 of the sand mold 1.

TABLE 1

| | | | (weight %) | | | |
|---|---|---|---|---|---|---|
| C | Si | Mn | P | S | Cr | Fe |
| 0.10 | 1.2 | 0.6 | 0.01 | 0.01 | 17.0 | Bal. |

Figure 3:
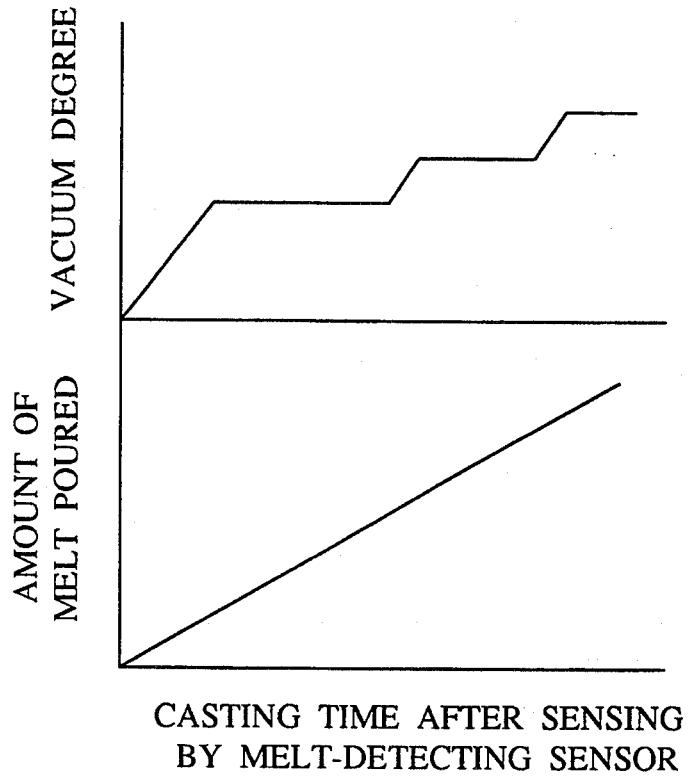
FIG. 3 is a graph showing the relation between the casting time and the vacuum degree and the amount of the melt poured.

The evacuation of the cavity 12 through the hole 19 was started upon detecting the flow of the melt M with the melt-detecting sensor 13. As shown in FIG. 3, the vacuum degree of the sand mold 1 was increased stepwise by the vacuum control means 26.

The resulting thin, cylindrical cast articles with flanges were inspected. As a result, no defects such as insufficient filling, leak defects, the inclusion of air, blow holes, etc. were observed at all. Thus, it may be concluded that the cast articles produced by the method of the present invention were good products free from defects.

EXAMPLE 2

A two-part, cold box-type sand mold 1 having a cavity as shown in FIG. 4 was produced from silica sand #6. The cavity 12 containing a core 12*e* had a cylindrical hollow portion 12*a* having an outer diameter of 45 mm, a length of 200 mm and a thickness of 2.5 mm, flange-shaped hollow portions 12*b*, 12*c* having an outer diameter of 80 mm and a thickness of 10 mm disposed on both sides of the cylindrical hollow portion 12*a*, and two bosses 12*d* having a diameter of 10 mm and a height of 15 mm.

A molding (diameter: 0.4 mm, thickness: 20 mm) of coarse sand (#4) was placed as a high-gas permeability member 18 between the rise/run-off portion 16 and the hole 19. This high-gas permeability member 18 had a gas permeability of 550 (JIS). Also, the inner walls of the cavity 12, the sprue 14 and the gate 15 were coated with a mold wash of zircon at a thickness of 0.15 mm.

An opening 22 of sucking pipe 24 constituted by a flexible pipe was brought into close contact with the opening 19*a* of the hole 19 to conduct evacuation by a vacuum pump 21.

A melt having a composition shown in Table 2 was poured into the sprue 14 of the sand mold 1.

TABLE 2

| | | | (weight %) | | | |
|---|---|---|---|---|---|---|
| C | Si | Mn | P | S | Cr | Fe |
| 0.10 | 1.2 | 0.6 | 0.01 | 0.01 | 17.0 | Bal. |

The evacuation of the cavity 12 through the hole 19 was started upon detecting the flow of the melt M with the melt-detecting sensor 13.

After casting, the sand mold 1 was broken by shake-out in a shake-out station. By this method, 50 cast steel articles were produced. The resulting thin, cylindrical cast articles with flanges were inspected. As a result, no defects such as insufficient filling, leak defects, the inclusion of air, blow holes, etc. were observed at all.

EXAMPLE 3

A two-part, cold box-type sand mold 1 having a cavity as shown in FIG. 5 and 6 was produced from silica sand #7. The cavity 12 containing a hollow, high-gas permeability core 3 had a cylindrical hollow portion 12*a* having an outer diameter of 45 mm, a length of 200 mm and a thickness of 2.5 mm, flange-shaped hollow portions 12*b*, 12*c* having an outer diameter of 80 mm and a thickness of 10 mm disposed on both sides of the cylindrical hollow portion 12*a*, and two bosses 12*d* having a diameter of 10 mm and a height of 15 mm.

The hollow, high-gas permeability core 3 was produced by a shell molding process using silica sand #6 and a 2.5-% phenolic resin binder. The hollow, high-gas permeability core 3 had a gas permeability of 60 (JIS).

High-gas permeability members 18 (diameter: 0.3 mm, thickness: 15 mm) of coarse sand (#5) were placed between the opening of the hollow, high-gas permeability core 3 and the hole 19 and between the rise/run-off portions 16 and the hole 19. Each of these high-gas permeability members 18 was a $CO_2$ mold containing 6% of water glass and having a gas permeability of 400 (JIS).

An opening 22 of a sucking pipe 24 constituted by a flexible pipe was brought into close contact with the opening 19*a* of the hole 19 to conduct evacuation by a vacuum pump 21.

A melt having a composition shown in Table 3 was poured into the sprue 14 of the sand mold 1.

TABLE 3

| | | | (weight %) | | | |
|---|---|---|---|---|---|---|
| C | Si | Mn | P | S | Cr | Fe |
| 0.10 | 1.2 | 0.5 | 0.01 | 0.01 | 17.1 | Bal. |

Figure 7:
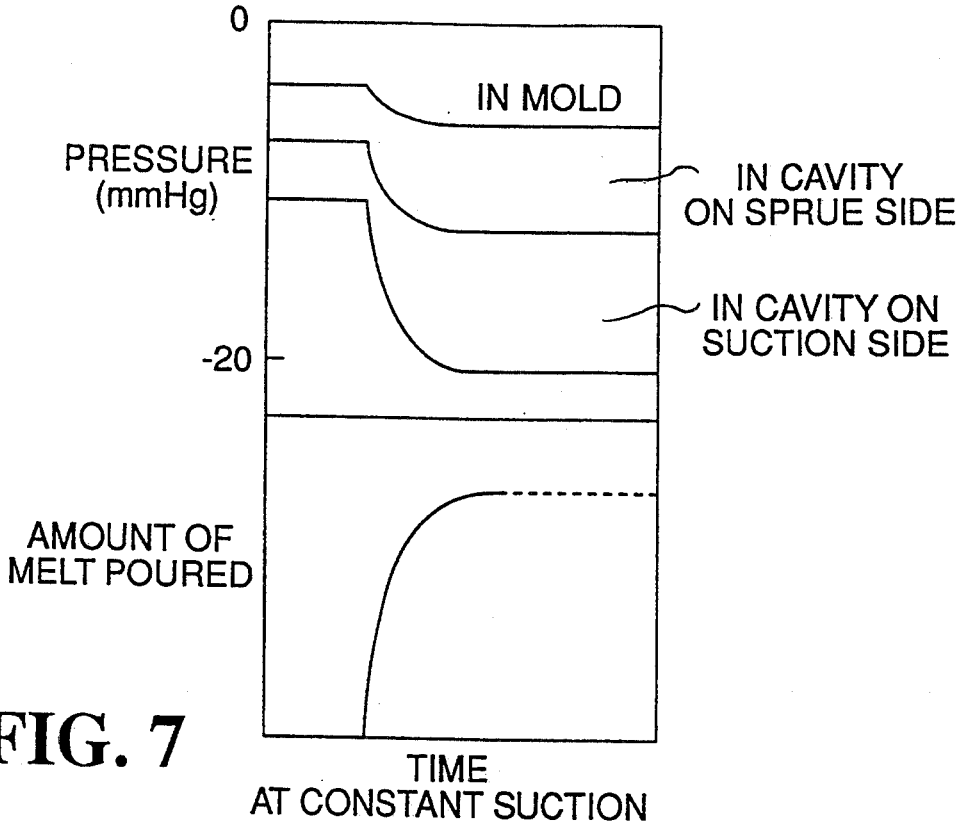
FIG. 7 is a graph showing the relation between the casting time and the pressure and the amount of the melt poured in a case where evacuation is conducted at a constant vacuum degree (at a suction opening of the vacuum apparatus)
Figure 8:
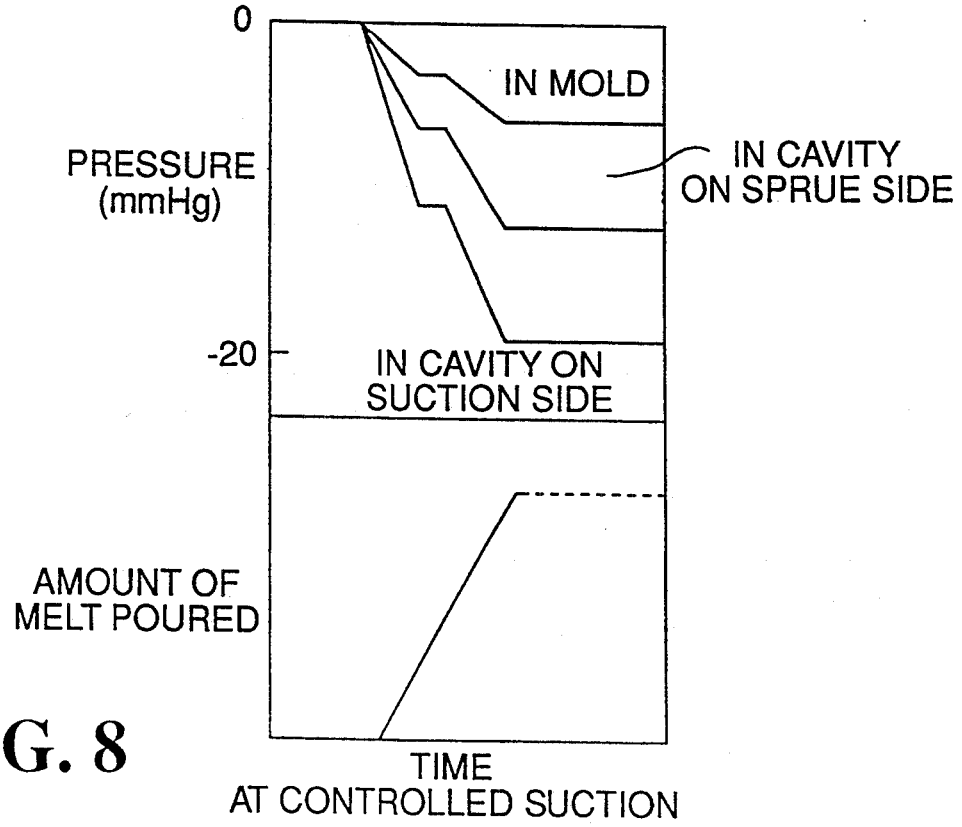
FIG. 8 is a graph showing the relation between the casting time and the pressure and the amount of the melt poured in a case where evacuation is conducted at a linearly increasing vacuum degree (at a suction opening of the vacuum apparatus)

The evacuation of the cavity 12 through the hole 19 was started upon detecting the flow of the melt M with the melt-detecting sensor 13. The pressure (mmHg) was measured in the sand mold 1, in the cavity 12 on the side of the gate 15, and in the cavity 12 on the side of the rise/run-off portions 16 and the end opening of the hollow, high-gas permeability core 3, and the pressure change was monitored as the time passed. The results are shown in FIGS. 7 and 8. FIG. 7 shows the relation between the casting time and the pressure and the amount of the melt poured at a constant vacuum degree, and FIG. 8 shows the relation between the casting time and the pressure and the amount of the melt poured at a controlled vacuum degree. For comparison, FIG. 9 shows the relation between the casting time and the pressure and the amount of the melt poured in various portions of the sand mold 1, in the case of using no hollow, high-gas permeability core 3.

After casting, the sand mold 1 was broken by shake-out in a shake-out station. By this method, 30 cast steel articles were produced in each of the pressure reduction patters shown in FIGS. 7–9.

In the pressure reduction patters shown in FIGS. 7 and 8, the pressure in the cavity 12 on the side of the rise/run-off portions 16 and the end opening of the core 3 was lower than that on the side of the gate 15, leading to a faster melt flow with little disturbance. The resulting thin, cylindrical cast articles with flanges were inspected. As a result, no defects such as insufficient filling, leak defects, the inclusion of air, blow holes, etc. were observed at all.

Figure 9:
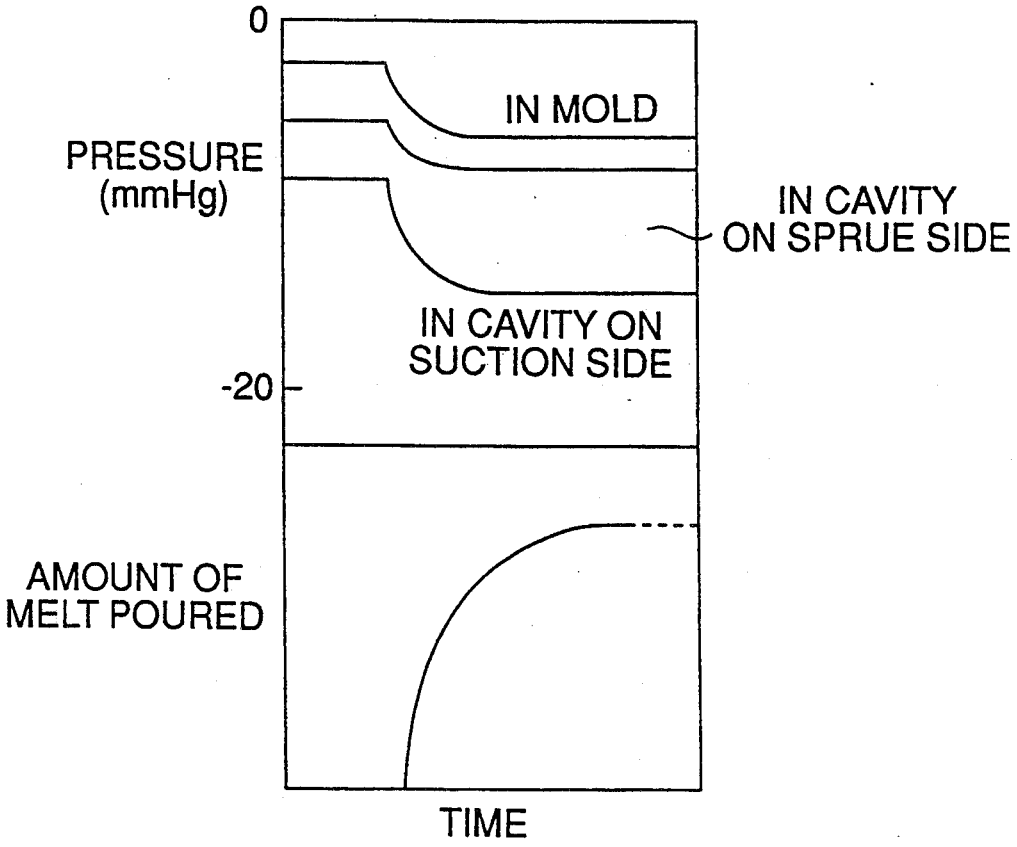
FIG. 9 is a graph showing the relation between the casting time and the pressure and the amount of the melt poured in various portions of the permeable mold, which was obtained without using the hollow, high-gas permeability core 3 in Example 3.

On the other hand, in the pressure reduction pattern shown in FIG. 9, the melt flow was slower than those shown in FIGS. 7 and 8, and 18 cast steel articles had casting defects due to the insufficient filling.

EXAMPLE 4

A two-part, cold box-type sand mold 1 having a cavity 12 as shown in FIG. 10 was produced from silica sand #6. The cavity 12 containing a hollow, high-gas permeability core 3 had a branched hollow portion 12*a* having an outer diameter of 40 mm and a thickness of 2.3 mm, flange-shaped hollow portions having a thickness of 10 mm connected to end openings of the branched hollow portion 12*a*, and five bosses 12*d* having a diameter of 10 mm and a height of 15 mm.

The hollow, high-gas permeability core 3 was produced by a shell molding process using silica sand #6 and a 2.5-% phenolic resin binder. The hollow, high-gas permeability core 3 had a gas permeability of 60 (JIS).

High-gas permeability members 18 (diameter: 0.3 mm, thickness: 15 mm) of coarse sand (#4) were placed between the end openings of the hollow, high-gas permeability core 3 and the hole 19 and between the rise/-run-off portions 16 and the hole 19. Each of these high-gas permeability members 18 was a $CO_2$ mold containing 6% of water glass and having a gas permeability of 400 (JIS).

An opening of a sucking pipe constituted by a flexible pipe was brought into close contact with the opening of the hole 19 to conduct evacuation by a vacuum pump.

A melt having a composition shown in Table 4 was poured into the sprue 14 of the sand mold 1.

TABLE 4

| | | | (weight %) | | | |
|---|---|---|---|---|---|---|
| C | Si | Mn | P | S | Cr | Fe |
| 0.21 | 1.1 | 0.6 | 0.01 | 0.01 | 18.4 | Bal. |

The evacuation of the cavity 12 through the hole 19 was started upon detecting the flow of the melt M with the melt-detecting sensor 13. After casting, the sand mold 1 was broken by shake-out in a shake-out station. By this method, 50 cast steel articles were produced at a constant vacuum degree according to the pressure reduction patter shown in FIG. 7. The pressure in the cavity 12 on the side of the rise/run-off portions 16 and the end openings of the core 3 was lower than that on the side of the gate 15, leading to a faster melt flow with little disturbance. The resulting thin, cylindrical cast articles with flanges were inspected. As a result, no defects such as insufficient filling, leak defects, the inclusion of air, blow holes, etc. were observed at all.

As described above in detail, since the melt can flow through the sprue, gate and cavity of the sand mold without including the air and gas generated from the sand mold in the present invention, cast steel articles free from casting defects can be obtained. Also, since the flow speed of the melt is increased, the casting time can be reduced. In addition, since the sand mold is not placed in a chamber or a box, there is no fear that the chamber or the box is exploded by gas generated from the sand mold.

The method and apparatus of the present invention having the above features are particularly suitable for producing thin cast steel articles.

Although the present invention has been explained referring to the attached drawings and Examples, the present invention is not restricted to them, and various modifications are possible unless they deviate from the scope of the present invention defined by the claims attached hereto.

What is claimed is:

1. A method of producing a cast steel article in a permeable mold having a sprue, a cavity in communication with the sprue, and a rise/run-off portion in communication with the cavity, the method comprising the steps of:

forming a hole in a surface of the mold, the hole terminating at a location in the mold and spaced from the rise/run-off portion, the hole terminating closer to the rise/run-off portion than the sprue;

pouring a steel melt into the sprue to fill the cavity; and evacuating the formed hole to reduce the pressure in the rise/run-off portion and the cavity in a direction from the sprue toward the rise/run-off portion.

2. The method according to claim 1, wherein the step of evacuating comprises controlling a rate of reduction of the pressure to flow the melt into the cavity at a substantially constant speed.

3. The method according to claim 1 or 2 further comprising sensing the presence of steel melt in the mold prior to the cavity, and commencing evacuation upon sensing the presence of the steel melt.

4. The method according to claim 3 further comprising detecting when the steel melt is poured into the sprue and placing means for evacuation into a ready state.

5. An apparatus for producing a cast steel article, said apparatus comprising:

a permeable mold having a sprue, a cavity in communication with the sprue, and at least one rise/run-off portion in communication with the cavity, said permeable mold being provided with a hole having an opening on a mold surface, said hole terminating at a location in said mold and spaced from and adjacent to said rise/run-off portion; and a vacuum apparatus having a suction pipe with an opening which is brought into contact with said hole of said permeable mold, wherein the air is sucked from said hole by said vacuum apparatus drawing the air from said rise/run portion through said permeable mold and into said hole, in order to conduct the casting of said article at reduced pressure.

6. The apparatus for producing a cast steel article according to claim 5, wherein said vacuum apparatus comprises a vacuum pump, and a vacuum control means disposed between said vacuum pump and said opening, said vacuum control means being operated to control the vacuum degree in said cavity such that said melt is introduced into said cavity at a substantially constant speed.

7. The apparatus for producing a cast steel article according to claim 5 or 6, wherein a filter is disposed in said permeable mold between said sprue and a gate.

8. The apparatus for producing a cast steel article according to claim 7, wherein a melt-detecting sensor is disposed in said gate so that the suction is started immediately after sensing said melt by said melt-detecting sensor.

9. The apparatus for producing a cast steel article according to claim 8, wherein inner walls of said cavity, said sprue, said gate and said rise/run-off portion are at least partially coated with a mold wash.

10. The apparatus for producing a cast steel article according to claim 9, wherein an outer wall of said permeable mold is at least partially coated with a mold wash.

11. An apparatus for producing a cast steel article, said apparatus comprising a permeable mold having a sprue, a cavity in communication with the sprue, and at least one rise/run-off portion in communication with the cavity, said permeable mold being provided with a hole having an opening on a mold surface, said hole terminating at a location in said mold and spaced from and adjacent to said rise/run-off portion; and a vacuum apparatus having a suction pipe with an opening which is brought into contact with said hole of said permeable mold, and at least one high-gas permeability member having a larger gas permeability than that of said permeable mold being disposed in said permeable mold between said hole and said rise/run-off portion and/or said cavity, wherein air is sucked from said hole by said vacuum apparatus, in order to conduct the casting of said article at reduced pressure.

12. The apparatus for producing a cast steel article according to claim 11, wherein a filter is disposed in said permeable mold between said sprue and a gate.

13. The apparatus for producing a cast steel article according to claim 11 or 12, wherein a melt-detecting sensor is disposed in said gate so that the suction is started immediately after sensing said melt by said melt-detecting sensor.

14. The apparatus for producing a cast steel article according to claim 13, wherein inner walls of said cavity, said sprue, said gate and said rise/run-off portion are at least partially coated with a mold wash.

15. The apparatus for producing a cast steel article according to claim 14, wherein an outer wall of said permeable mold is at least partially coated with a mold wash.

16. An apparatus for producing a cast steel article, said apparatus comprising a permeable mold having a sprue, a gate in communication with the sprue, a cavity in communication with the gate, and at least one rise/-run-off portion in communication with the cavity, and a vacuum apparatus having a vacuum pump and a suction pipe, said permeable mold being provided with a hole having an opening on a mold surface, said hole terminating at a location in said mold and spaced from and adjacent to said rise/run-off portion, said cavity containing at least one hollow, permeable core, one end of which is connected to said hole via a high-gas permeability member having a larger gas permeability than that of said permeable mold, the air being sucked from said hole by said vacuum apparatus, in order to conduct the casting of said article at reduced pressure.

17. The apparatus for producing a cast steel article according to claim 16, wherein a filter is disposed in said permeable mold between said sprue and said gate.

18. The apparatus for producing a cast steel article according to claim 16 or 17, wherein a melt-detecting sensor is disposed in said gate so that the suction is started immediately after sensing said melt by said melt-detecting sensor.

19. The apparatus for producing a cast steel article according to claim 18, wherein inner walls of said cavity, said sprue, said gate and said rise/run-off portion are at least partially coated with a mold wash.

20. The apparatus for producing a cast steel article according to claim 19, wherein an outer wall of said permeable mold is at least partially coated with a mold wash.

21. The apparatus for producing a cast steel article according to claim 20, wherein the vacuum degree in said cavity is larger in a portion nearer said rise/run-off portion than in a portion nearer said gate.

22. The apparatus for producing a cast steel article according to claim 16, wherein said at least one hollow, permeable core is a high-gas permeability core.

* * * * *